US005883652A

United States Patent [19]

Moser et al.

[11] Patent Number: 5,883,652

[45] Date of Patent: Mar. 16, 1999

[54] DEVICE FOR FILLING UP A CONTAINER WITH FLUID

[75] Inventors: Markus Moser, Volketswil; Luzius Betschon, Uster, both of Switzerland

[73] Assignee: Pelikan Produktions AG, Zurich, Switzerland

[21] Appl. No.: 646,128

[22] Filed: Mar. 26, 1996

[30] Foreign Application Priority Data

Jul. 25, 1995 [DE] Germany ..... 29512003 U

[51] Int. Cl.[6] ..... B41J 2/175

[52] U.S. Cl. ..... 347/85

[58] Field of Search ..... 347/84–87

[56] References Cited

U.S. PATENT DOCUMENTS

| | | | |
|---|---|---|---|
| 4,419,677 | 12/1983 | Kasugawana et al. | 347/87 |
| 4,500,895 | 2/1985 | Buck et al. | 347/87 |
| 4,967,207 | 10/1990 | Ruder | 347/87 |
| 5,329,294 | 7/1994 | Ontawar et al. | 347/87 |
| 5,510,820 | 4/1996 | Aulick et al. | 347/85 |
| 5,555,007 | 9/1996 | Ceschin et al. | 347/85 |

FOREIGN PATENT DOCUMENTS

| | | | |
|---|---|---|---|
| 0 567 308 A2 | 4/1993 | European Pat. Off. . | |
| 0 611 656 A2 | 12/1993 | European Pat. Off. . | |
| 0 603 910 A1 | 6/1994 | European Pat. Off. . | |
| 0 645 243 A2 | 9/1994 | European Pat. Off. . | |
| 295 02 908.0 | 5/1995 | Germany . | |
| 106729 | 4/1994 | Japan | 347/86 |
| WO 94/11194 | 11/1993 | WIPO . | |
| WO 95/18049 | 12/1994 | WIPO . | |

*Primary Examiner*—N. Le
*Assistant Examiner*—Michael P. Nghiem
*Attorney, Agent, or Firm*—Fay, Sharpe, Beall, Fagan, Minnich & McKee

[57] ABSTRACT

The device comprises a cylinder (1) which is filled less than half with ink (2). In its initial state, there is directly above ink (2) a piston (3) with piston rod (4) and handle (5). At the lower end there is arranged at the cylinder (1) a hollow needle (6) with a sealing ring (7). For re-filling of a print head (10) its nozzle openings (11) are sealed and needle (6) is adjusted through an opening of lid (13) up to sealing abutment of ring (7). The piston (3) is pulled up and the air from the print head (10) is thereby suctioned through the ink (2). As a result of the negative pressure, the ink (2) is then suctioned into head (10). The device has a simple design.

8 Claims, 2 Drawing Sheets

DEVICE FOR FILLING UP A CONTAINER WITH FLUID

BACKGROUND OF THE INVENTION

The subject invention concerns a device and method for filling a solution into a container.

The invention is especially suited for refilling ink cartridges of ink jet print heads and will be described with reference thereto; however, the invention is capable of broader application and could be used for filling many different liquids into a variety of containers.

SUMMARY OF THE INVENTION

A device for refilling ink into a print head of an ink jet printer is known from German Utility Model Patent 295 02 908. It includes two cylinders arranged in side-by-side relationship. One cylinder contains ink and the other a piston which operates during filling as suction pump. Hollow needles protrude from both cylinders. Both needles are inserted into the container of the print head. The tips of the hollow needles are protected by cone shaped elements which are pulled off prior to use.

The present invention is based on the objective to improve this device. This task is solved by the combination of characteristics of the claims.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
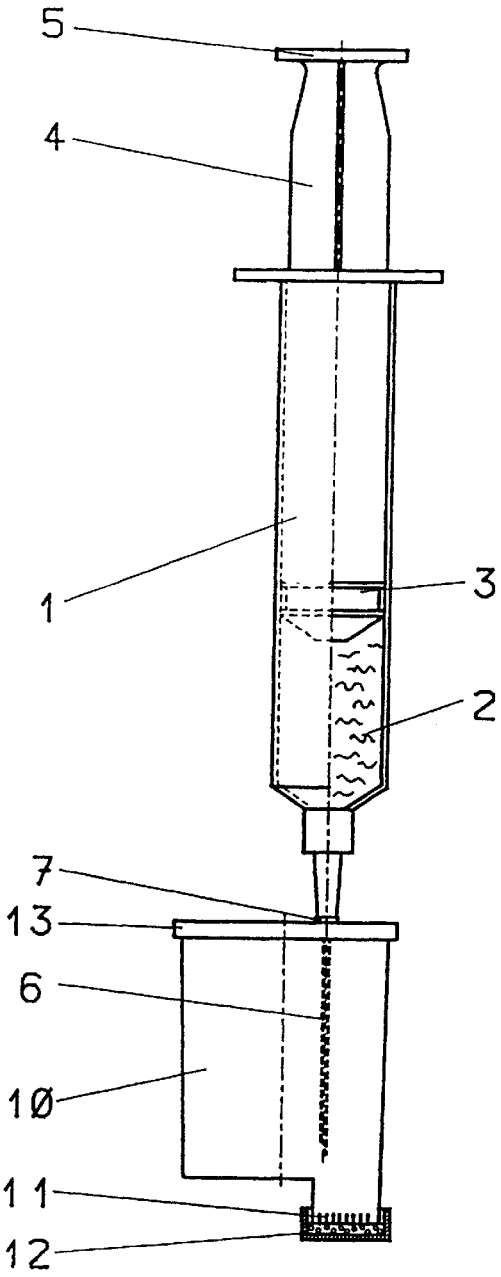
FIG. 1 is a side elevational view (particularly in cross-section) showing a first embodiment of the invention preparatory to filling ink into an ink cartridge of an ink jet print head.
Figure 2:
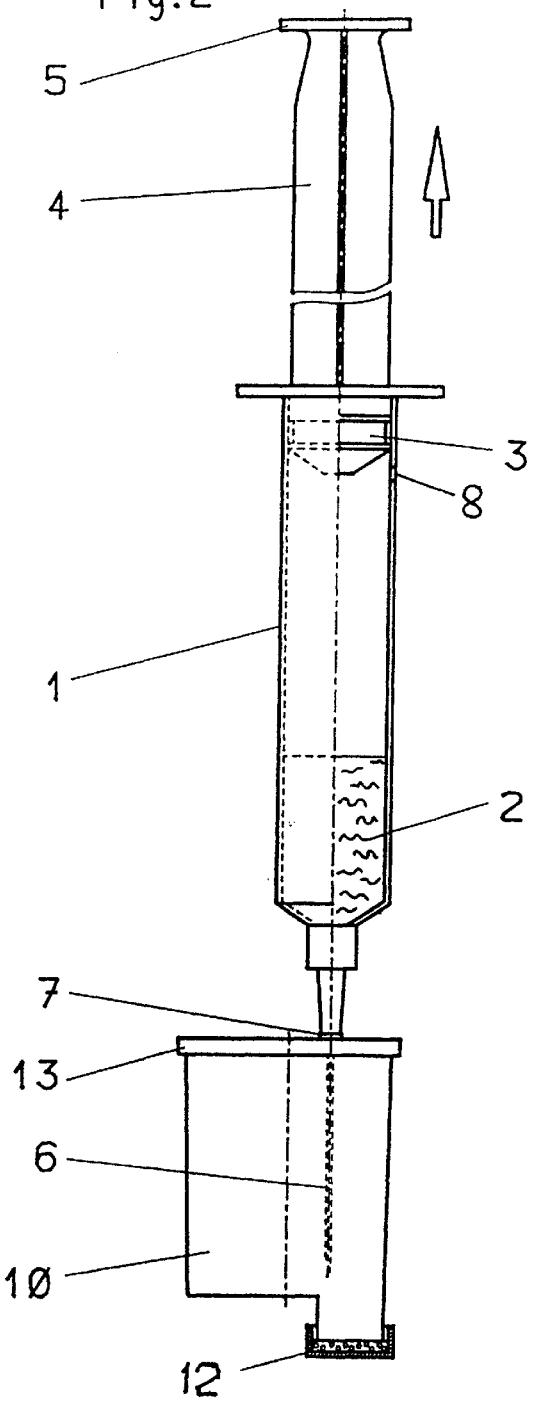
FIG. 2 is view like FIG. 1 but showing a subsequent stage of he filling operation.
Figure 3:
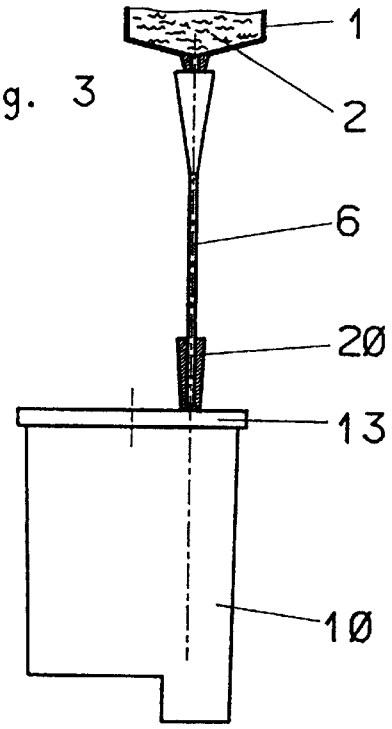
FIG. 3 is a partial, side elevational view of a second embodiment of the invention showing a preliminary step in filling ink into an ink cartridge.
Figure 4:
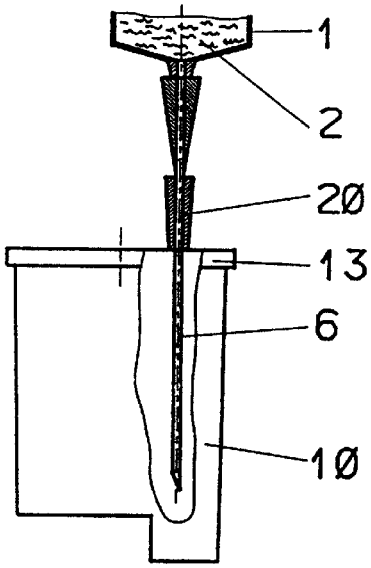
FIG. 4 is view like FIG. 3 but showing a subsequent stage of the filling operation.
Figure 6:
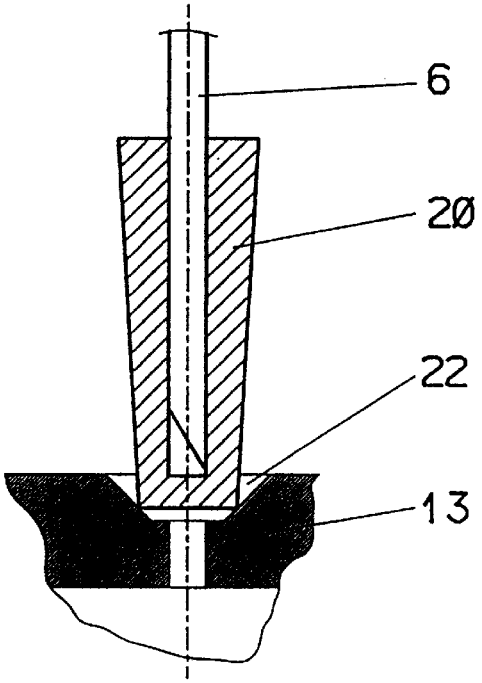
Figure 5:
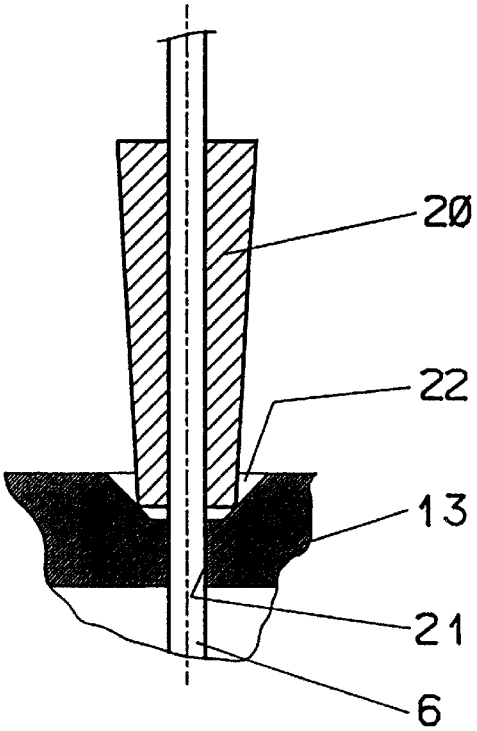
FIG. 5 is an enlarged cross-sectional view showing the needle and cone of the FIG. 3 embodiment in position for the filling operation; and, FIG. 6 is a view like FIG. 5 but showing the elements prior to movement of the needle into the ink cartridge.

Referring now to the drawings wherein the showings are for the purposes of illustrating the preferred embodiment of the invention only and not for purposes of limiting same, the device according to FIGS. 1 and 2 comprises a cylinder 1, of which a fraction, i.e., preferably less than one half, is filled with ink 2. In the initial state as shown in FIG. 1 there is immediately above the ink 2, a piston 3 with a piston rod 4. The piston rod 4 has a handle 5 at its free end. At the lower end of cylinder 1 there is a hollow needle 6 with a sealing ring 7.

For refilling of print head 10, its outlet jet openings 11 are first hermetically sealed with a suitable sealing cover 12 capable of preventing air inflow. Through an opening in lid 13 of print head 10, the hollow needle 6 is inserted up to the sealing emplacement of sealing ring 7 against lid 13. Subsequently, the piston 3 is lifted into the position shown in FIG. 2. As a result, a portion of the air in print head 10 is suctioned off through the ink in cylinder 1. Upon releasing handle 5, the ink 2 is suctioned into a foam body 32 in the ink storage chamber portion of print head 10 due to the negative pressure prevailing therein. In order to facilitate the inflow of ink 2, cylinder 1 can have an air supply or vent opening 8 in the vicinity of its upper end. Air flows through this opening as soon as the piston 3 has reached it upper end position illustrated in FIG. 2.

The described device is significantly less complicated than the one according to the initially mentioned German Utility Model Patent 295 02 908 and requires providing only one single opening in lid 13 of print head 10, which is usually present in any case. It has been demonstrated that as a result of suctioning of ink under vacuum into the foam body 32, it is filled significantly more efficiently and a decline of filling capacity after several fillings can be prevented. This is attributable to the fact that due to the negative pressure, the air in the air-filled pores of the foam body 32 is suctioned off.

The specific embodiment according to FIGS. 3 to 6 primarily differs from the one according to FIGS. 1 and 2 in that in the delivery state, a cone 20 is attached on the free end of the hollow needle 6. The cone 20 remains on the needle and is pushed into sealing engagement with the lid 13 of print head 10 during insertion of the hollow needle 6. The cone 20 is centered in a conical counter-bore 22 arranged coaxially vis-a-vis the opening 21 in lid 13. As a result of this design it is achieved that the cone 20 need not be removed prior to insertion of needle 6. Thus, with the omnipresent excess pressure of ink 2 in cylinder 1, no ink will squirt from needle 6 into the environment. This specific embodiment is also suitable for filling the print head under pressure, where, in fact, the piston 3 is not first pulled upward, but is pressed downward. This presupposes that the print head is not air-tight. The cone 20 serves, at the same time, as a limit stop (see FIG. 5) when needle 6 is inserted, so that the needle penetrates to the optimal distance within print head 10.

The described device is also suitable for filling other containers with fluid, for example in the medical field.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A device for filling a solution into a container of a print head of an ink jet printer, the container including a container wall having an opening defined therethrough, the device comprising a cylinder containing the solution and including a hollow needle projecting from an end of the cylinder, and a sealing element surrounding the hollow needle for sealingly engaging the container wall adjacent said opening when the hollow needle is inserted in the container through the opening, the hollow needle includes a tip and the sealing element is formed by a cone disposed over and sealing the tip of the hollow needle, when the hollow needle is inserted into the container through the opening, the cone being pierced by the hollow needle.

2. The device according to claim 1 further including a piston slidably received in the cylinder, the piston having a piston rod including a handle attached thereto.

3. A device for filling a solution into a container of a print head of an ink let printer, the container including a container wall having an opening defined therethrough, the device comprising a cylinder containing the solution and including a hollow needle projecting from an end of the cylinder, a sealing element surrounding the hollow needle for sealingly engaging the container wall adjacent said opening when the hollow needle is inserted in the container through the opening, and a piston slidably received in the cylinder, the piston having a piston rod including a handle attached thereto, the solution filling only a fraction of the cylinder so that when the piston is withdrawn from the cylinder, air is suctioned from the container through the solution.

4. The device according to claim 3 wherein the cylinder has, in the vicinity of the end opposite the hollow needle an air vent opening (8).

5. A device for filling an ink tank of an ink let printhead with ink, the ink tank having an opening, the device comprising:

a cylinder for containing ink and having a first and a second end;

a hollow needle projecting from the first end of the cylinder and having a distal end adapted for insertion into the opening of the ink tank;

an elongated rod slidably received within the second end of the cylinder; and a sealing member disposed peripherally around the hollow needle, the sealing member for sealing engaging against the ink tank to form a seal upon insertion of the hollow needle into the opening of the ink tank such that fluid passing through the opening of the ink tank only passes through the hollow needle, the sealing member enclosing the distal end of the hollow needle, the sealing member being pierced by the hollow needle upon inserting the hollow needle into the opening of the ink tank.

6. The device as set forth in claim 5 wherein the hollow needle slides through the sealing member and into the opening of the ink tank while the sealing member being in sealing engagement with the ink tank.

7. The device as set forth in claim 5 wherein upon insertion of the hollow needle into the opening of the ink tank, the seal formed by the sealing member against the ink tank maintains a negative pressure within the ink tank by withdrawing the elongated rod from the cylinder.

8. The device as set forth in claim 7 further including an air vent defined through the cylinder adjacent the second end of the cylinder.

* * * * *